US006077366A

United States Patent [19]

Ogasa

[11] Patent Number: 6,077,366

[45] Date of Patent: Jun. 20, 2000

[54] PROCESS FOR PRODUCING A HIGH-PURITY HARD GOLD ALLOY

[76] Inventor: Kazuo Ogasa, 1858-229, Nakano, Tukuichou, Tukui-gun, Kanagawa 220-02, Japan

[21] Appl. No.: 08/953,801

[22] PCT Filed: Mar. 4, 1996

[86] PCT No.: PCT/JP96/00510

§ 371 Date: Apr. 7, 1995

§ 102(e) Date: Apr. 7, 1995

[87] PCT Pub. No.: WO96/31632

PCT Pub. Date: Oct. 10, 1996

[30] Foreign Application Priority Data

Apr. 7, 1995 [JP] Japan ..... 7-117587
Apr. 7, 1995 [JP] Japan ..... 7-117588

[51] Int. Cl.[7] ..... C21D 5/00

[52] U.S. Cl. ..... 148/538; 148/430; 148/678

[58] Field of Search ..... 148/678, 538, 148/405, 430

[56] References Cited

U.S. PATENT DOCUMENTS

| | | | |
|---|---|---|---|
| 3,667,937 | 6/1972 | Ingersoll et al. | 420/507 |
| 4,885,135 | 12/1989 | Hosada et al. | 420/507 |
| 5,071,619 | 12/1991 | Hosada et al. | 420/507 |

FOREIGN PATENT DOCUMENTS

| | | | |
|---|---|---|---|
| 145183 | 11/1980 | Germany | 148/678 |
| 58-096741 | 6/1983 | Japan . | |
| 63-57753 | 3/1988 | Japan . | |
| 63-243238 | 10/1988 | Japan | C22C 5/02 |
| 1-127635 | 5/1989 | Japan | C22C 5/02 |
| 2-170931 | 7/1990 | Japan | C22C 5/02 |
| 7-70670 | 3/1995 | Japan . | |
| 7-70671 | 3/1995 | Japan . | |
| 7-90425 | 4/1995 | Japan . | |
| 8-157983 | 6/1996 | Japan . | |
| 9-143647 | 6/1997 | Japan . | |
| 9-143648 | 6/1997 | Japan . | |
| 2 116 208 | 9/1983 | United Kingdom . | |

OTHER PUBLICATIONS

Toshinori, Ishii, "Gold Ornament Material Hardened By Alloying With Small Amount of Component", *Patent Abstracts of Japan,* vol. 095, No. 006, Jul. 31, 1995 of JP 07 070671 (Mar. 14, 1995).

Toshinori, Ishii, "Gold Ornament Material Hardened By Alloying With Small Amount of Component", *Patent Abstracts of Japan,* vol. 095, No. 006, Jul. 31, 1995 of JP 07 070670 (Mar. 14, 1995).

Shotaro, Shimizu, "Manufacture of Personal Ornaments", *Patent Abstracts of Japan,* vol. 012, No. 279 (C–517), Aug. 1, 1988 of JP 63 057753 (Mar. 12, 1988).

Chiharu, Funaki, "Au Material For Precision Cast Product", *Patent Abstracts of Japan,* vol. 095, No. 007, Aug. 31, 1995 of JP 07 090425 (Apr. 4, 1995).

Ott, D and C.J. Raub "Effect of Small Additions on the Properties of Gold and Gold Alloys" in METALL (Jul. 1980), 34(7), 629–633.

*Primary Examiner*—Scott Kastler
*Attorney, Agent, or Firm*—Frishauf, Holtz, Goodman, Langer & Chick, P.C.

[57] ABSTRACT

A process for producing a hard high purity gold alloy comprising (a) casting a high purity gold alloy consisting essentially of from 50 to 3000 ppm Gd and balance being gold, the gold having a purity of at least 99.7%, (b) solution treating the alloy at a temperature above 700° C., and (c) aging the alloy at a temperature of 150 to 350° C.

6 Claims, 4 Drawing Sheets

| TREATMENT | | CASTING | +SOLUTION HEAT -TREATMENT +AGING | +WORKING (ROLLING) | +AGING | +WORKING (DICING) | +AGING |
|---|---|---|---|---|---|---|---|
| Gd 0.138% | ⊖ | 47 | 80 | 115 | 116 | 123 | 123 |
| Gd 0.094% Ca 0.049% | ■ | 63 | 88 | 106 | 145 | 166 | 176 |
| Gd 0.110 Al 0.029 | ◇ | 64 | 73 | 109 | 122 | 142 | 155 |
| Gd 0.119 Si 0.029 | ✳ | 81 | 102 | 115 | 121 | 120 | 135 |
| Ca 0.21 | + | 60 | 67 | 107 | 117 | 132 | 138 |
| Gd 0.005 | ◆ | 43 | 61 | 73 | 74 | 80 | 80 |

DEPENDENCE OF HIGH-PURITY HARDENED GOLD ALLOYS OF THE PRESENT INVENTION ON HEAT TREATMENT CONDITIONS

| TREATMENT | | CASTING | +SOLUTION HEAT −TREATMENT +AGING | +WORKING (ROLLING) | +AGING | +WORKING (DICING) | +AGING |
|---|---|---|---|---|---|---|---|
| Gd 0.138% | ⊖ | 47 | 80 | 115 | 116 | 123 | 123 |
| Gd 0.094% Ca 0.049% | ■ | 63 | 88 | 106 | 145 | 166 | 176 |
| Gd 0.110 Al 0.029 | ◇ | 64 | 73 | 109 | 122 | 142 | 155 |
| Gd 0.119 Si 0.029 | ✳ | 81 | 102 | 115 | 121 | 120 | 135 |
| Ca 0.21 | + | 60 | 67 | 107 | 117 | 132 | 138 |
| Gd 0.005 | ◆ | 43 | 61 | 73 | 74 | 80 | 80 |

DEPENDENCE OF HIGH-PURITY HARDENED GOLD ALLOYS OF THE PRESENT INVENTION ON HEAT TREATMENT CONDITIONS

| TREATMENT | CASTING | SOLUTION HEAT TREATMENT +HEAT TREATMENT |
|---|---|---|
| Gd 0.148% | 48 | 82 |
| Sm 0.160% | 48 | 48 |
| Ce 0.180% | 55 | 60 |
| Dy 0.180 | 50 | 49 |
| Ca 0.123 | 60 | 67 |

DEPENDENCE OF HIGH-PURITY HARDENED GOLD ALLOYS ON ELEMENTS ADDED

| TREATING TEMPERATURE (°C) | 150 | 250 | 350 | 450 |
|---|---|---|---|---|
| Gd 0.149% | 123 | 125 | 120 | 108 |
| Gd 0.094 Ca 0.049 | 176 | 177 | 157 | 126 |
| Al 0.186 | 123 | 116 | 69 | 49 |
| Gd 0.110 Al 0.029 | 146 | 149 | 137 | 108 |
| Si 0.182 | 118 | 89 | 46 | 35 |
| Gd 0.116 Si 0.031 | 140 | 133 | 115 | 65 |

DEPENDENCE OF HIGH-PURITY HARDENED GOLD ALLOYS OF THE PRESENT INVENTION ON AGING TREATMENT TEMPERATURE

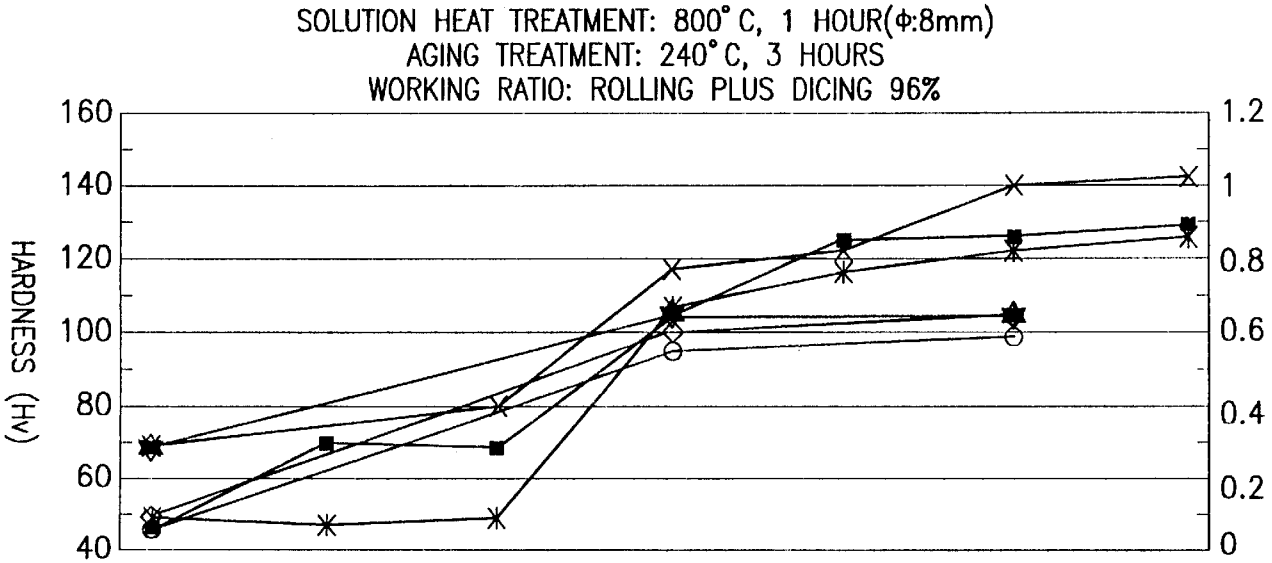

| TREATMENT | CASTING | SOLUTION HEAT -TREATMENT (800°C,1 HOUR) | AGING TREATMENT (250°C,3 HOURS) | ROLLING 90% | AGING TREATMENT (250°C,3 HOURS) | DICING T99% | AGING TREATMENT (250°C,3 HOURS) |
|---|---|---|---|---|---|---|---|
| Gd 0.139% NOT HEAT TREATED ⊖ | 46 | | | 95 | | 99 | |
| HEAT TREATED ■ | 46 | 70 | 68 | 104 | 125 | 126 | 128 |
| Sm 0.159 NOT HEAT TREATED ◇ | 49 | | | 100 | | 104 | |
| NOT HEAT TREATED ✳ | 49 | 47 | 48 | 106 | 115 | 122 | 125 |
| Gd 0.072 Sm 0.092 NOT HEAT TREATED ✱ | 69 | | | 104 | | 104 | |
| HEAT TREATED × | 69 | | 79 | 117 | 122 | 140 | 142 |

FIG.4 DEPENDENCE OF HIGH-PURITY HARDENED GOLD ALLOYS OF THE PRESENT INVENTION ON HEAT TREATMENT CONDITIONS DEPENDENCE ON HEAT TREATMENT

PROCESS FOR PRODUCING A HIGH-PURITY HARD GOLD ALLOY

This application is a continuation of International Application No. PCT/JP96/00510, filed Mar. 4, 1996, the entire contents of which are hereby incorporated by reference herein.

BACKGROUND OF THE INVENTION

1. Field of the Invention

Gold matrices generally used for jewelry include alloys such as 14-karat or 18-karat gold alloy, and Ni, Pd, Zn, etc. are added in large quantities to these alloys to increase their hardness or tensile strength. These alloys cannot therefore be called pure gold in respect of purity.

A high-purity gold alloy according to the present invention has a purity of 99.7% or more, and its hardness is increased to a level approximately equivalent to that of 18-karat gold at a relatively low working ratio by (1) adding trace elements and (2) performing a heat treatment in the process of a production process, thereby eliminating the drawbacks accompanying the enhancement of purity, that is, improving the workability, heat resistance, flaw resistance, etc.

2. Background Information

High-purity gold jewelry is low in hardness and it is extremely difficult to retain its aesthetic value for a long term in daily life. Also, a heat treatment performed during the production process, such as brazing, inevitably causes a great reduction in the hardness. The use of high-purity gold as ornaments is therefore limited.

Alloys obtained according to the present invention had a gold content of 99.8% or more and their Vickers hardness (Hv) was as high as 100 or more for cast articles and 150 or more for worked articles. Even with the use of compositions qualifying as pure gold, the hardness Hv was higher than 100 for cast articles and higher than 150 for worked articles (working ratio: 99.6%). In the case where a heat treatment was performed with Gd added, the pure gold according to the present invention was remarkably increased in hardness and also improved in heat resistance. The pure gold thus obtained is less liable to be marred or scratched and undergoes less variation with time, and reduction in the hardness due to a heat treatment such as brazing is small.

To obtain high-purity hardened pure gold capable of retaining a high-quality look for a long term, research was conducted and as a result, an alloy with high hardness was obtained which contained 99.7% by weight or more of gold, to which was added 50 ppm or more of Gd as an alloying component, along with another element so that the total amount of the additional elements was 100 to 3000 ppm. Reduction in the hardness of this member due to heat treatment was small. Adding a smaller amount of the elements resulted in lower hardness, and the hardness was nearly proportional to the tensile strength.

As the heat treatment for obtaining the above high-purity gold alloy, solution heat treatment, rapid cooling and aging treatment were performed. The resulting alloy was less lowered in hardness by welding, brazing or the like and thus can retain high aesthetic value for a long term, proving to be suitable as an alloy for use as high-purity gold jewelry.

SUMMARY OF THE INVENTION

An object of this invention is to provide a high-purity hard gold alloy which is improved in workability, heat resistance, flaw resistance, etc. and thus can eliminate the drawbacks associated with high-purity gold alloy, and a process of producing such a gold alloy.

According to this invention, there is provided a high-purity hard gold alloy which is characterized in that 50 ppm or more of Gd and one or more of other elements are contained as additional elements in Au having a purity of 99.7% by weight or more such that a total content of the additional elements is 100 to 3000 ppm.

Preferably, in this case, Al or Ca is contained in the alloy as the other elements and Gd amounts for 10% by weight or more of the additional elements. Alternatively, the other elements contained in the above alloy preferably include Si, and Gd accounts for 50% by weight or more of the additional elements.

These gold alloys have a high Vickers hardness Hv of 150 or more.

This invention also provides a process of producing a high-purity hard gold alloy characterized in that, after casting a high-purity gold alloy having a purity of 99.7% by weight or more, a solution heat treatment is performed at 700° C. or more and then an aging treatment is performed at 150 to 350° C. as a post-treatment, or the aging treatment at 150 to 350° C. alone is performed.

According to this invention, moreover, a process of producing a high-purity hard gold alloy is provided which is characterized in that, after casting a high-purity gold alloy having a Gd content of 50 ppm or more contained in Au having a purity of 99.7% by weight or more, a solution heat treatment is performed at 700° C. or more and then an aging treatment is performed at 150 to 350° C. as a post-treatment, or the aging treatment at 150 to 350° C. alone is performed.

Further, this invention provides a process of producing a high-purity hard gold alloy which process is characterized in that, after casting a high-purity gold alloy which contains 100 ppm or more of one or more of elements selected from rare earth elements and alkaline earth elements in Au having a purity of 99.7% by weight or more, a solution heat treatment is performed at 700° C. or more and then an aging treatment is performed at 150 to 350° C. as a post-treatment, or the aging treatment at 150 to 350° C. alone is performed.

according to this invention, the gold content is as high as 99.7% by weight or more since, in the case of ornamental members in general, high gold content is preferred because of high-quality look. Where 50 ppm or more of Gd was added, the hardness was increased by the heat treatment and working, and reduction in the hardness due to brazing, welding or the like lessened, showing advantageous effects of the additional element.

The addition of trace elements and the heat treatment could provide a remarkable hardening effect for both cast and worked articles. The hardened high-purity gold alloy had a gentle softening curve and was improved in hardness, tensile strength and heat resistance.

By selecting a third element to be added, it is possible to select either thermal hardening or work hardening. For cast articles, hardening is achieved by (1) adding an extra element and (2) performing heat treatment, and for worked articles, work hardening is also utilized in combination. Since the present invention employs a thermal hardening process, hardening is observed at an initial stage of the production process. The working cost could be greatly cut down and also unnecessary working time could be eliminated.

Where Gd and another element were added in combination so that these components coexisted in a total amount of 100 to 3000 ppm, the hardness was increased at an initial stage of the production process and reduction of the hardness due to application of heat could be lessened. The alloy obtained undergoes less variation with time and thus is suitable as a high-purity hardened gold alloy.

BRIEF DESCRIPTION OF THE DRAWINGS

FIG. 4 is a graph which shows dependence of high-purity hardened gold alloys on heat treatment conditions, that is, dependence on heat treatment itself.

BEST MODE OF CARRYING OUT THE INVENTION

This invention will be hereinafter described with reference to specific examples. Evaluation samples shown in FIGS. 1 and 2 were obtained by melting gold alloys having the respective compositions and pure gold by high-frequency vacuum melting, casting the melt into ingots of 20 mm×20 mm×150 mm, and then subjecting the ingots to heat treatment, rolling and dicing to obtain wire of 0.8 mm in diameter Φ.

In the case of evaluation samples shown in FIG. 4, wires of 8 mm in diameter Φ were obtained by continuous casting following the high-frequency vacuum melting. After the wires were subjected to solution heat treatment, aging treatment, rolling and dicing, hardness and tensile strength were evaluated and also the elements contained were analyzed.

The results revel that the hardness can be greatly increased by performing the solution heat treatment following the casting and by performing the aging treatment following the working, thus proving high thermal hardening effect.

Figure 1:
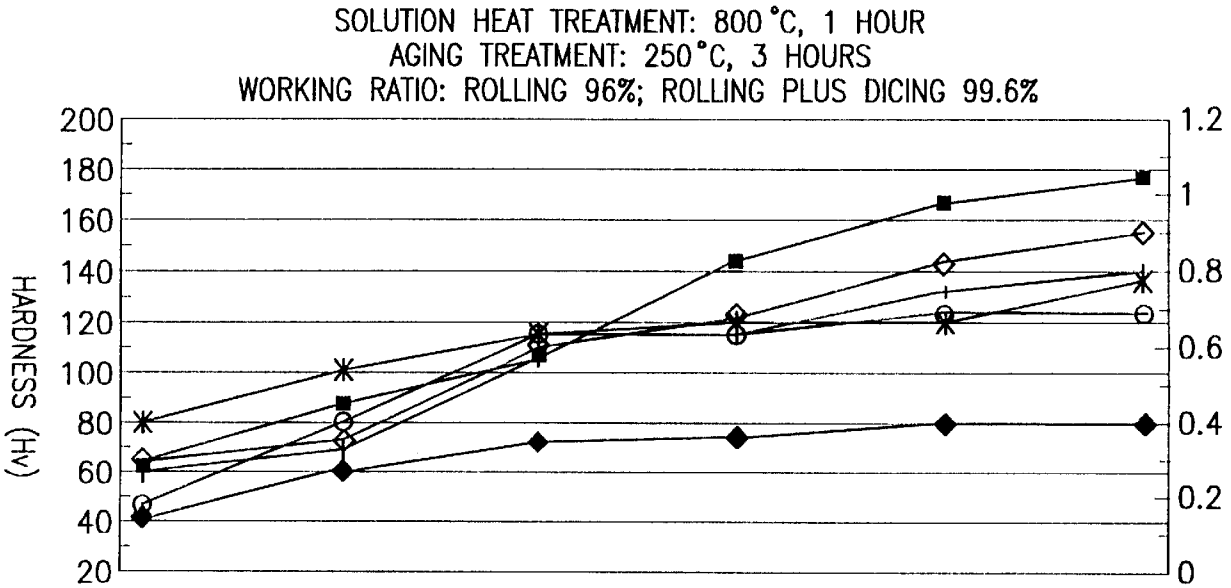
FIG. 1 is a graph which shows dependence of high-purity hardened gold alloys according to the present invention on heat treatment conditions.

With regard to the gold-alloy ornamental members according to the present invention, obtained by the aforementioned process, and pure-gold ornamental members, micro-Vickers hardness (load: 100 g) was measured after the casting, before and after the heat treatment, and before and after the working. The results are shown in FIG. 1. If the amount of Gd added is small in quantity, then the effect of the heat treatment as well as the heat resistance is lower. On the other hand, if an increased amount of Si is added, a crack is caused during the working. The article containing both Gd and Ca has a hardness Hv as high as 170, which is higher by about 40% than that of the article containing Gd alone and higher by about 25% than that of the article containing Ca alone.

Figure 2:
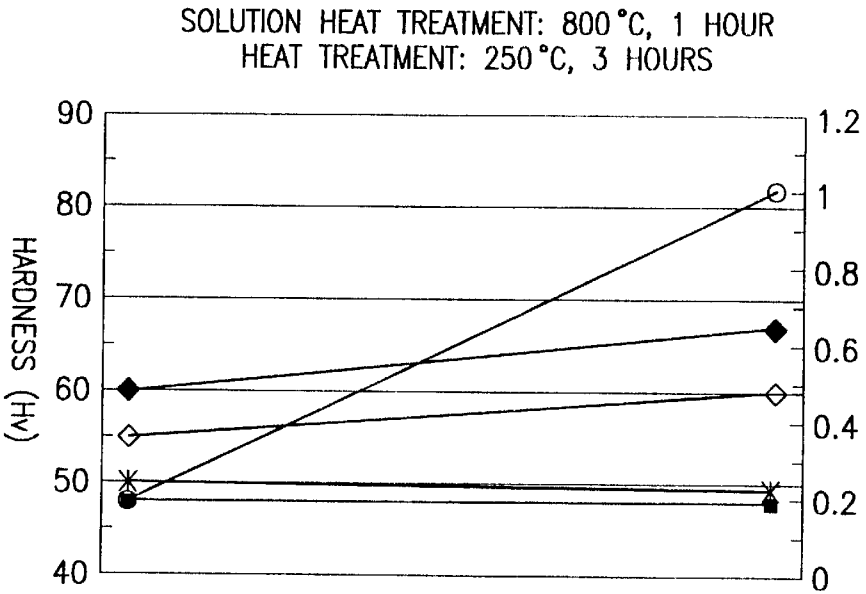
FIG. 2 is a graph which shows dependence of high-purity hardened gold alloys on elements added.

Articles containing rare earth elements tend to show high heat resistance, and among them, the article containing Gd exhibits the highest heat resistance, proving a remarkable effect of the heat treatment as shown in FIG. 2.

The cast article containing both Gd and Si has a hardness Hv of 100, which is higher by about 64% than that of the article containing Gd alone. The article containing Si alone is extremely low in heat resistance.

Figure 3:
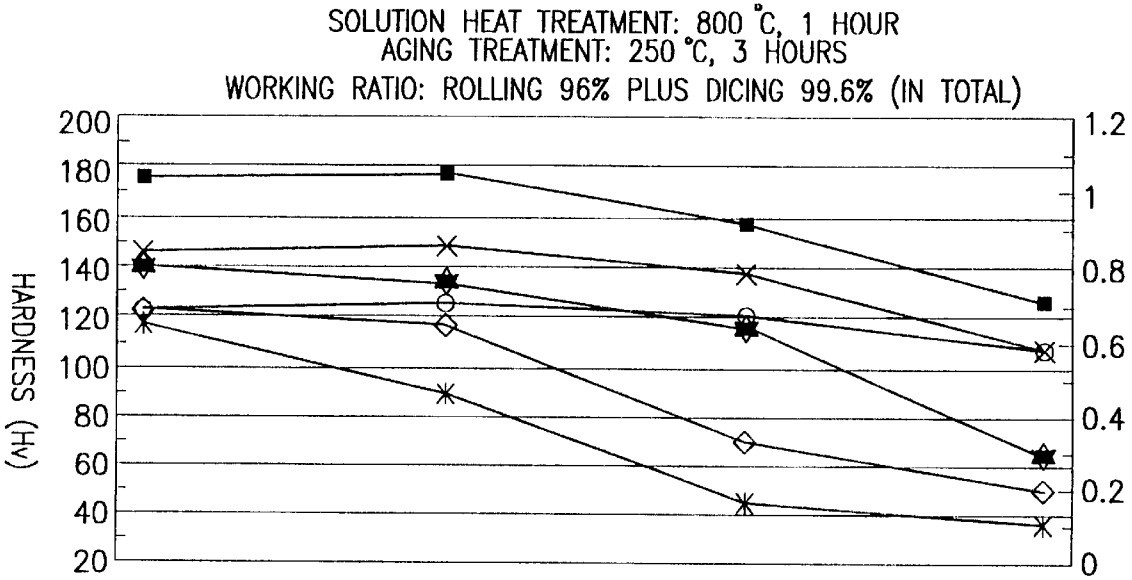
FIG. 3 is a graph which shows dependence of high-purity hardened gold alloys on aging treatment temperature.

For the purpose of evaluation, samples were prepared using Gd (rare earth element) showing a high age hardening effect and Ca (alkaline earth metal ) showing a high work hardening effect, and excellent results were obtained in both cases. By applying the production process of the present invention, the hardness could be increased approximately by 30%, as shown in FIG. 4. Similar results were obtained also in cases where elements were added in combination. As shown in FIG. 3, articles containing Gd showed a high hardness after being subjected to an aging treatment at a temperature of 150 to 350° C.

The high-purity gold-alloy ornamental member according to the present invention has high hardness and improved heat resistance, as compared with pure-gold ornamental members on the market, and the hardness thereof is scarcely lowered due to application of heat. Further, the inspection after a lapse of 10 months revealed no substantial variation with the passage of time in respect of hardness, tensile strength and color tone.

Thus, the high-purity hardened gold alloy member according to the present invention can retain these properties for a long term, and accordingly, is highly useful in the industrial field where it is put to practical use in a variety of ornamental articles.

Also, the high-purity hardened gold alloy according to the present invention may probably be used in other fields, such as in electronic parts, medical parts, etc.

The alloy compositions and conditions for the results depicted in FIGS. 1 to 4 are set forth in the following TABLES 1 to 4, respectively.

TABLE 1

DEPENDENCE OF HIGH-PURITY HARDENED GOLD ALLOYS OF THE PRESENT INVENTION ON HEAT TREATMENT CONDITIONS

| TREATMENT | | CASTING | +SOLUTION HEAT −TREATMENT +AGING | +WORKING (ROLLING) | +AGING | +WORKING (DICING) | +AGING |
|---|---|---|---|---|---|---|---|
| Gd 0.138% | ⊖ | 47 | 80 | 115 | 116 | 123 | 123 |
| Gd 0.0954% Ca 0.049% | ■ | 63 | 88 | 106 | 145 | 166 | 176 |
| Gd 0.110 Al 0.029 | ◊ | 64 | 73 | 109 | 122 | 142 | 155 |
| Gd 0.119 Si 0.029 | ✳ | 81 | 102 | 115 | 121 | 120 | 135 |
| Gd 0.21 | + | 60 | 67 | 107 | 117 | 132 | 138 |
| Gd 0.005 | ♦ | 43 | 61 | 73 | 74 | 80 | 80 |

TABLE 2

DEPENDENCE OF HIGH-PURITY HARDENED GOLD ALLOYS ON ELEMENTS ADDED

| TREATMENT | | CASTING | SOLUTION HEAT TREATMENT +HEAT TREATMENT |
|---|---|---|---|
| Gd 0.148% | ⊖ | 48 | 82 |
| Sm 0.160% | ■ | 48 | 48 |
| Ce 0.0180% | ◊ | 55 | 60 |
| Dy 0.180 | ✳ | 50 | 49 |
| Gd 0.21 | ♦ | 60 | 67 |

TABLE 3

DEPENDENCE OF HIGH-PURITY HARDENED GOLD ALLOYS OF THE PRESENT INVENTION ON AGING TREATMENT TEMPERATURE

| TREATING TEMPERATURE (°C.) | | 150 | 250 | 350 | 450 |
|---|---|---|---|---|---|
| Gd 0.149% | ⊖ | 123 | 125 | 120 | 108 |
| Gd 0.094% Ca 0.049 | ■ | 176 | 177 | 157 | 126 |
| Al 0.186 | ◊ | 123 | 116 | 69 | 49 |
| Gd 0.110 Al 0.029 | ✳ | 146 | 149 | 137 | 108 |
| Si. 0.182 | ✳ | 118 | 89 | 46 | 35 |
| Gd 0.116 Si 0.031 | ✱ | 140 | 133 | 115 | 65 |

What is claimed is:

1. A process for producing a high-purity hard gold alloy comprising:

(a) casting a high-purity gold alloy consisting essentially of from 50 to 3000 ppm Gd with the balance being gold, said gold having a purity of at least 99.7% by weight, (b) solution treating said alloy at a temperature of 700° C. or more and (c) aging said alloy at a temperature of 150 to 350° C.

2. The process of claim 1, wherein the gold alloy has a Vickers hardness of 150 or more.

3. The process of claim 1, wherein the solution heat treatment was performed at 800° C. for 1 hour.

4. The process of claim 1, wherein the aging was performed at 250° C. for 3 hours.

5. The process of claim 3, wherein the aging was performed at 250° C. for 3 hours.

6. A process for producing a high-purity hard gold alloy comprising:

(a) casting a high-purity gold alloy consisting essentially of 50 ppm or more Gd and one or more elements selected from the group consisting of Ca, Al, and Si, with the balance being gold, said gold having a purity of at least 99.7% by weight, and the total amount of Gd, Ca, Al, Si being from 100 to 3000 ppm,

TABLE 4

DEPENDENCE OF HIGH-PURITY HARDENED GOLD ALLOYS OF THE PRESENT INVENTION ON HEAT TREATMENT CONDITIONS DEPENDENCE ON HEAT TREATMENT

| TREATMENT | | CASTING | SOLUTION HEAT –TREATMENT (800° C., 1 HOUR) | AGING TREATMENT (250° C., 3 HOURS) | ROLLING 90% | TREATMENT (250° C., 3 HOURS) | DICING T99% | AGING TREATMENT (250° C., 3 HOURS) |
|---|---|---|---|---|---|---|---|---|
| Gd 0.139% | ⊖ | 46 | | | 95 | | 99 | |
| NOT HEAT TREATED | | | | | | | | |
| HEAT TREATED | ■ | 46 | 70 | 68 | 104 | 125 | 126 | 128 |
| Sm 0.159 | ◊ | 49 | | | 100 | | 104 | |
| NOT HEAT TREATED | ✳ | 49 | | | | | | |
| NOT HEAT TREATED | ✳ | 49 | 47 | 48 | 105 | 115 | 122 | 124 |
| Gd 0.072 Sm 0.092 | ✱ | 69 | | | 104 | | 103 | |
| NOT HEAT TREATED | | | | | | | | |
| HEAT TREATED | X | 69 | | 79 | 117 | 122 | 140 | 142 |

In the first column of each of the above Tables 1 to 4, the elements set forth are in terms of weight % in an alloy, wherein the remainder of the alloy is gold and inevitable impurities.

(b) solution treating said alloy at a temperature of 700° C. or more, and (c) aging said alloy at a temperature of 150 to 350° C.

* * * * *